US005391863A

United States Patent [19]

Schmidt

[11] Patent Number: 5,391,863

[45] Date of Patent: Feb. 21, 1995

[54] INDUCTION HEATING COIL WITH HOLLOW CONDUCTOR COLLABLE TO EXTREMELY LOW TEMPERATURE

[76] Inventor: Edwin Schmidt, Steingasse 25, 3563 Dautphetal 3, Germany

[21] Appl. No.: 81,275

[22] PCT Filed: Dec. 18, 1991

[86] PCT No.: PCT/DE91/00992

§ 371 Date: Jun. 22, 1993

§ 102(e) Date: Jun. 22, 1993

[87] PCT Pub. No.: WO92/11647

PCT Pub. Date: Jul. 9, 1992

[30] Foreign Application Priority Data

Dec. 22, 1990 [DE] Germany ..... 4041603
Mar. 26, 1991 [DE] Germany ..... 4109818

[51] Int. Cl.[6] ..... H05B 6/42

[52] U.S. Cl. ..... 219/677; 219/632; 174/15.6; 336/62

[58] Field of Search ..... 219/677, 674, 632, 10.79, 219/10.491, 15.1, 15.6, 16.1; 336/57, 60, 62

[56] References Cited

U.S. PATENT DOCUMENTS 630,501 8/1899 Greenfield ..... 174/15.1
2,277,223 3/1942 Goodridge ..... 219/677
3,593,242 7/1971 Andersson et al. ..... 336/62
4,241,233 12/1980 Bahder et al. ..... 174/15.6
4,247,736 1/1981 Grigoriev et al. ..... 219/677
5,049,840 9/1991 Gesche et al. ..... 336/62

FOREIGN PATENT DOCUMENTS 1167979 4/1964 Germany .
2260322 7/1974 Germany .

*Primary Examiner*—Philip H. Leung
*Attorney, Agent, or Firm*—David C. Purdue; John C. Purdue

[57] ABSTRACT

A hollow electrical conductor coolable to extremely low temperatures is disclosed. The conductor is hollow and has a connection for the introduction of extremely cold gases in a liquid or gaseous state and an outlet for the gases. At least one hose element (5; 24) is arranged in the hollow conductor (1; 19; 22; 23) and is connected to a gas connection and provided with perforations (6) to allow the gas to pass out. The hollow conductor (1; 19; 22; 23) is useful as an induction coil for induction furnaces for heating, keeping hot or melting metallic material. The external diameter of the hose element (5; 24) is smaller than the internal diameter of the hollow conductor (1; 19; 22; 23). The hollow conductor has passages (6a) in the wall to allow the gas to pass out and is fitted with a jacket (8) which provides an annular clearance to the hollow conductor and the gas emerging from the hollow conductor (1; 19; 22; 23) is collected and carried away.

14 Claims, 2 Drawing Sheets

Figure 1:
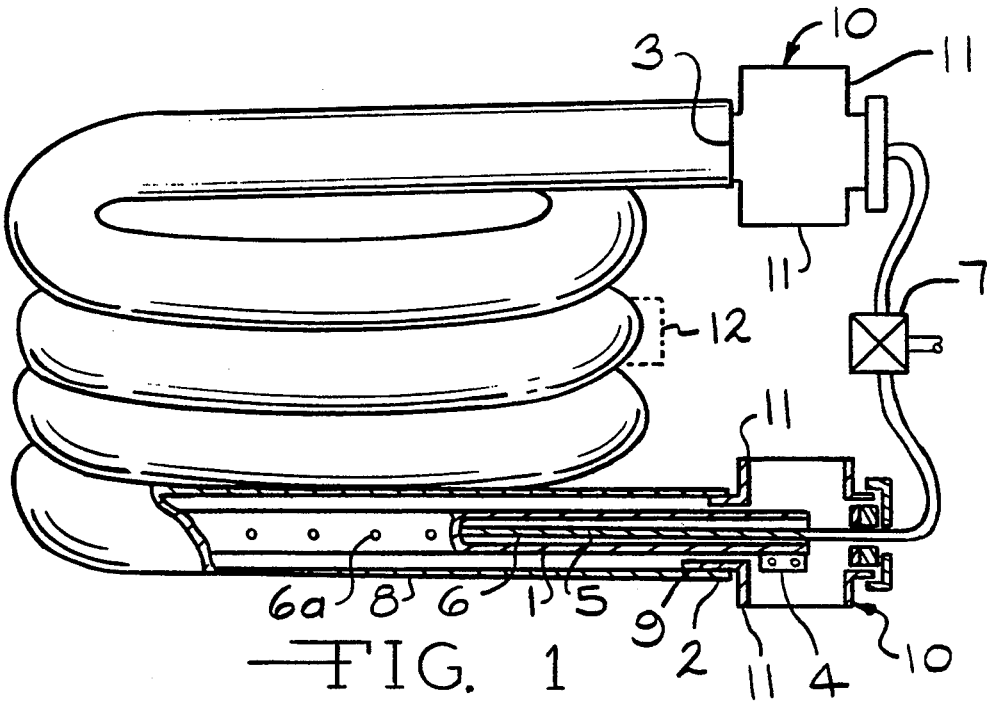

INDUCTION HEATING COIL WITH HOLLOW CONDUCTOR COLLABLE TO EXTREMELY LOW TEMPERATURE

DESCRIPTION

The invention concerns a hollow electrical conductor which can be cooled to extremely low temperatures with an inlet for gases cooled to extremely low temperatures, in the liquid or gaseous state, and an outlet for the gases. It also concerns methods for the application of such a hollow conductor.

It is known that cooling an electrical conductor to an extremely low temperature lowers its electrical resistance. This reduction in resistance for copper material is, for example, 0.4% for every degree Celsius reduction in temperature of this material. It follows therefore that the current level can be correspondingly reduced whilst maintaining the same useful power. Because the losses, i.e. current consumption heat, increases with the square of the increase in the current, a reduction in the current level leads to a correspondingly disproportionate reduction in the current consumption power to be dissipated. This means, for example, that if the current is halved the amount of current consumption heat to be dissipated is reduced to one quarter.

It is known (DE-OS 22 60 322, DE-PS 11 67 979 and US-PS 18 17 247) that to be able to draw off the heat due to the ohmic losses which occur with hollow electrical conductors a coolant can be passed through these conductors. Due to its high heat capacity, water is particularly important as a coolant. This means, however, that it is not possible to achieve a supercooling effect with a relevant drop in the electrical resistance of the conductor.

Furthermore, it is also already known ("Kernfusion, Forschung und Entwicklung". Kernforschungszentrum Karlsruhe, year 91, pages 57 to 62) that liquid gases which have been cooled to extremely low temperature can be sprayed into one end of a hollow conductor with a boiling effect and drawn off in the gaseous state at the other end of the hollow conductor. The disadvantage of this is that low temperatures are produced mainly only in the area where the liquid gas is sprayed in because in this area the boiling of the liquid gas produces low temperatures whilst in the following area of the hollow conductor only the evaporated gas, which has a substantially lower refrigerating potential relative to volume, can be effective.

The task of this invention is therefore to avoid the disadvantages of the aforementioned hollow conductors and procedures and to produce a hollow conductor over whose complete length the uniform distribution of a low temperature can be ensured. This should also bring about an economically effective cooling of the hollow conductor using a simple construction. Furthermore, procedures for the application of such a hollow conductor are to be given.

This task is solved by this invention by means of a hollow conductor as described in the introduction in that at least one hose element is arranged in the hollow conductor, is connected to a gas connection and provided with perforations for the outlet of the gases. The hose element or hose elements (5:24) produces the required uniform distribution of the coolant introduced in a gaseous form or in the liquid phase and therefore ensures a uniform cooling of the hollow conductor.

Disturbing, abrupt temperature changes in the conductor are therefore reliably avoided.

Hollow conductors of this kind are suitable for use for carrying current anywhere where very heavy current is used.

The hollow conductor can have either a round or rectangular cross section.

The hose element in accordance with the invention can be designed such that it passes through the entire hollow conductor and is connected at one end to a gab connection and sealed at the other end. It is also possible to be able to use two hose elements arranged from each end of the hollow conductor so that their combined lengths are matched to the length of the hollow conductor and each of which is connected to a gas connection. It is also possible to use just one hose element which is passed through the entire hollow conductor and connected at both ends to a gas connection.

To improve the uniform output of the gas in a liquid or gaseous state by providing the perforations of the hose element with a larger cross section with increasing distance from the gas connection and/or arranging the perforations of the hose element so that they are spaced closer together as a distance from the gas connection increases.

The hollow conductor in accordance with the invention can also be designed such that the external diameter of the hose element is smaller that the internal diameter of the hollow conductor. This produces a clearance between the outer surface of the hose element and the inner surface of the hollow conductor and promotes a uniform distribution of the coolant. The clearance between the aforementioned surfaces can be aided by spacer cams.

The hollow conductor in accordance with the invention can, furthermore, be designed such that it has a corrugated transverse profile. This produces channels running lengthwise along the hollow conductor for the guidance and distribution of the coolant emerging from a hose element.

The hollow conductor in accordance with the invention can, furthermore, be designed such that it has openings in its wall to allow the gas to pass through. This guides the coolant in such a way as to assist uniform distribution. The openings can be constructed as either through holes appropriately arranged in the wall of the hollow conductor or they can also be between cable strands or cores if the hollow conductor is constructed of such.

The hollow conductor in accordance with the invention can further be designed such that it is surrounded by a jacket which collects and removes the emerging gas. In this way the cooling of the hollow conductor can be assisted from outside. The gas collected in the jacket can be drawn off in any required manner or supplied for some further use.

The hollow conductor in accordance with the invention can also be designed such that the hollow conductor as a unit is housed in an enclosure which collects and takes away the gas emerging from the hollow conductor. It can be useful instead of a jacket for the conductor to enclose the complete hollow conductor, however it may be shaped, in a housing and to collect within the housing the gas emerging from the hollow conductor and supply it for any required use. In this case the gas cooled to a very low temperature can also provide external cooling of the hollow conductor.

The hollow conductor in accordance with the invention can also be designed such that a recovery device is provided for the gas escaping from the jacket or enclosure. This would reduce the amount of gas required.

The hollow conductor in accordance with the invention can also be in the shape of a coil. It can also be fitted in grooves of yokes fitted around a smelting crucible.

In accordance with a further proposal for the invention, the hollow conductor in accordance with the invention can be used as an induction coil for an induction furnace, for heating, keeping hot or melting metallic materials.

Otherwise the hollow conductor in accordance with the invention can be used in the most varied of applications for the generation of electrical magnetic fields. It can, for example, be used in particle accelerators, nuclear spin tomographs, in magneto hydrodynamics, plasma electricity, nuclear fusion reactors and in the construction of magnets.

In accordance with the invention, the hollow conductor can be operated in that liquid nitrogen or liquid helium in a gas cold liquefier circuit is supplied to the hose element for cooling. Passing through a circuit of this kind reduces the costs of the coolant.

The hollow conductor in accordance with the invention can also be operated in that the liquid nitrogen or liquid helium is supplied from a liquid gas tank to the hose element. This requires relatively low construction costs.

Furthermore, the hollow conductor in accordance with the invention can be operated in such a manner that gas from a pressure liquified circuit is applied to the hose element for cooling, which is particularly suitable for using freon or ammonia.

The following part describes, with the aid of drawings, some types of hollow conductor in accordance with the invention, These drawings show:

FIG. 1 A type of hollow conductor in accordance with the invention which is an induction coil with a perforated hose element and a surrounding jacket.

Figure 2:
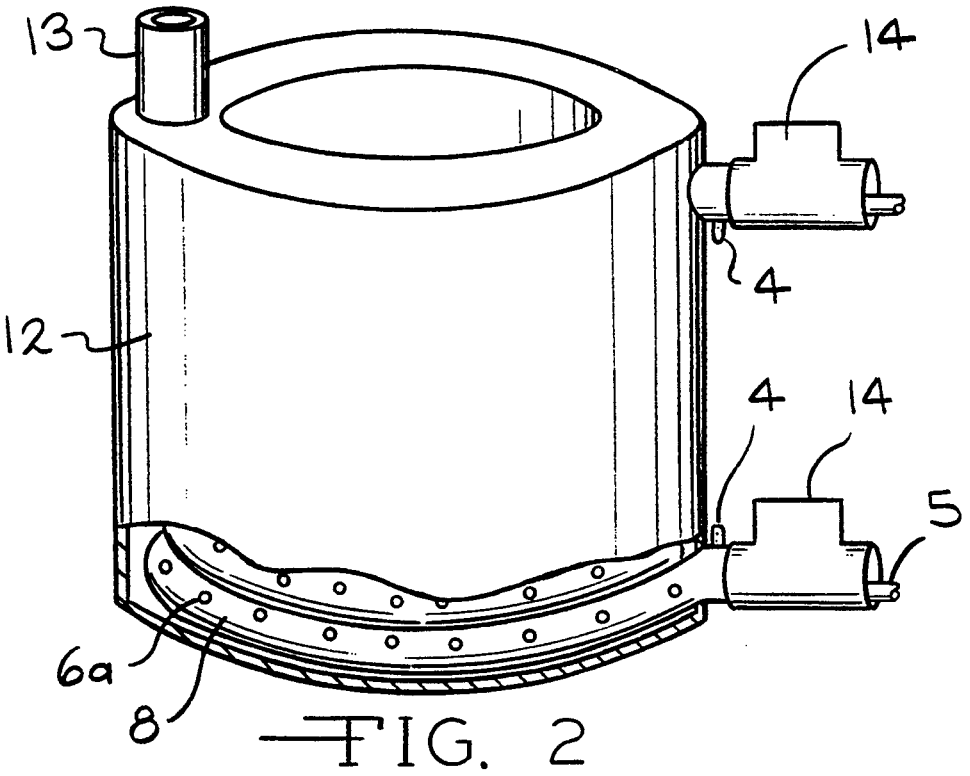

FIG. 2 A type similar to FIG. 1 where the hollow conductor in the form of an induction coil is totally enclosed in an enclosure.

Figure 3:
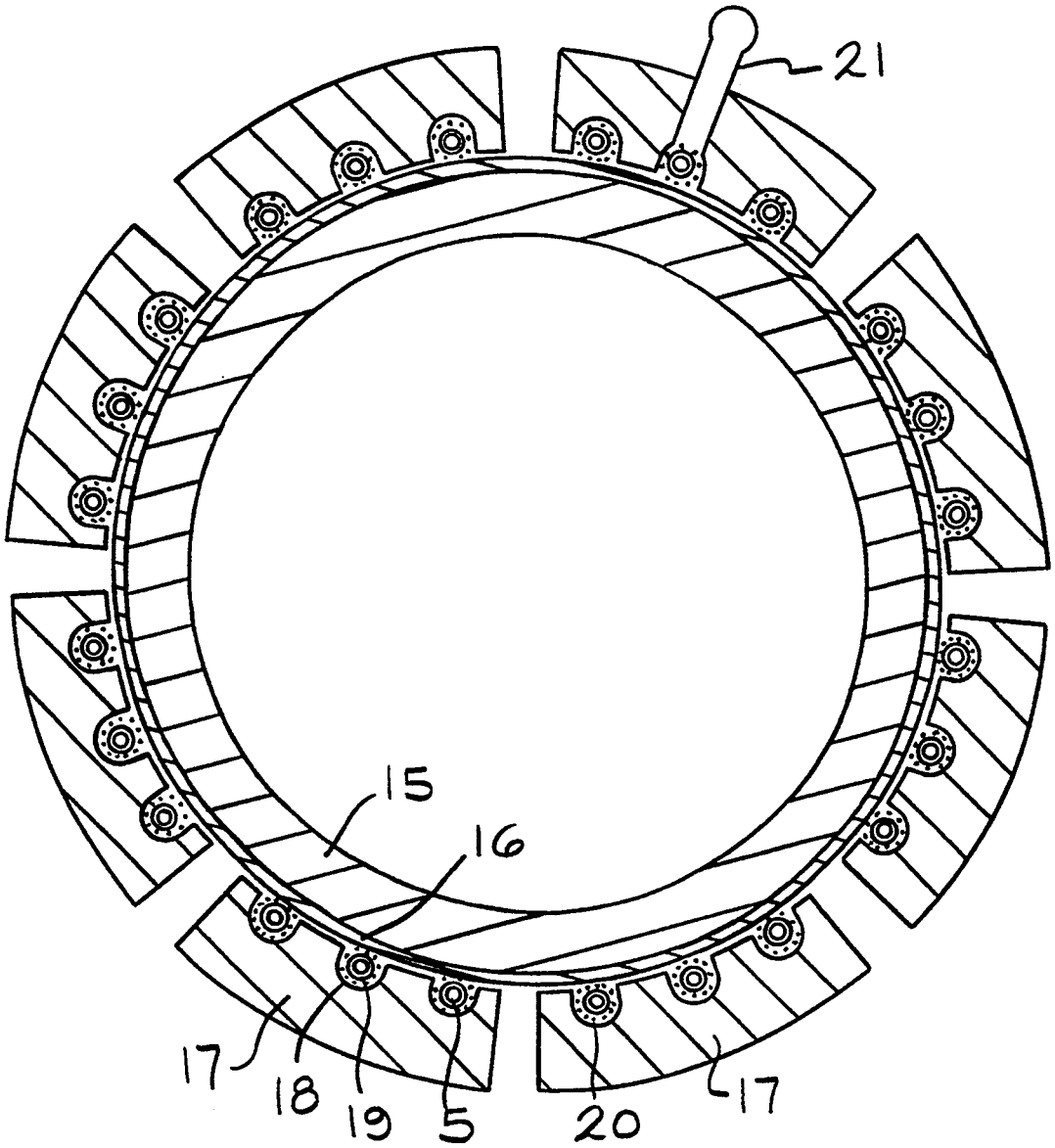

FIG. 3 A section through a crucible running normal to the axis, with a surrounding yoke in which grooves to take the hollow conductor are provided.

Figure 4:
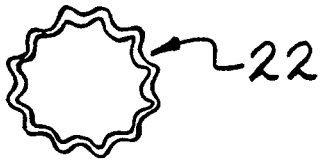

FIG. 4 A section through a hollow conductor with a corrugated-shaped cross section.

Figure 5:
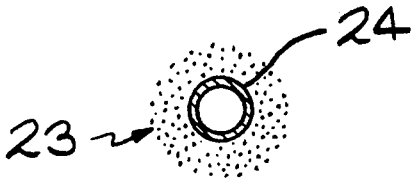

FIG. 5 A hollow conductor formed from cable strands, with a hose.

FIG. 1 shows a hollow electrical conductor (1) in the shape of an induction coil with a lower end (2) and an upper end (3). Electrical connections (4) are provided at both ends (2, 3). Within the hollow conductor (1) is fitted a hose element (5) of polytetrafluoroethylene (PTFE), whose outer diameter is less than the internal diameter of the hollow conductor (1) which is provided with holes (6*a*). The hose element (5) is provided with fine perforations (6) within the hollow conductor (1). Both ends of the hose element (5) are connected to a dosing device (7) which is also connected to a gas tank (not illustrated).

The hollow conductor (1) is located within a ring-shaped jacket (8) which allows an annular gap between the jacket and hollow conductor (1). The jacket (8) is connected at both ends to a nozzle (9) to which is fitted an adaptor (10) which can be connected by connector (11) to a gas pipe (not illustrated).

FIG. 1 also shows an adaptor (12) which can be connected to the inner space of the jacket (8) on one hand and to the gas pipe on the other.

For the construction in FIG. 1, the gas in liquid or gaseous form, (preferably liquid nitrogen) is introduced simultaneously to both ends of the hose element (5). It then passes through the perforations in the hollow conductor (1) and finally enters the jacket (8). This causes an intensive cooling of the hollow conductor (1) from the inside which is aided by the gas entering the jacket (8). The coolant which is then in a gaseous state cools not only the conductor but also the connected, associated elements. The gas then passes through a gas pipe to the outside or to a cooler (not shown) which can be a gas cold liquefier.

The design shown in FIG. 2 is different from that in FIG. 1 essentially only in that the induction coil formed by the hollow conductor (1) is completely enclosed in an enclosure (12) which has a connector (13) for the removal of the gas. Electrical connections (4) are provided at the ends of the hollow conductor (1), In addition, each end of the hollow conductor (1) carries an adaptor (14) which seals the hollow space of the hollow conductor (1) whilst at the same time allowing the end of the hose element (5) to pass through to the open as shown for the adaptor (10) in FIG. 1.

FIG. 3 shows a crucible (15) which is enclosed by an insulating foil (16). Yokes (17) are arranged in basket form to provide a supporting corset around the crucible. These yokes (17) are provided with grooves (18) on the side facing the crucible (15). A perforated hollow conductor (19) is located in these grooves and contains a hose element (5) in the manner already described. The hollow conductor (19) is embedded in each case in a permeable filler material (20).

The yokes (17) run parallel to the axis of the crucible (15). The grooves (18) and the hollow conductor (19) contained therein are also correspondingly arranged with the integrated hose elements (5). These are connected at the lower end in each case to a ring pipe (not illustrated), through which the gas cooled to very low temperature, in the liquid or gaseous state, is fed to the individual hose elements (5). This gas can be collected by means of a draw off connection (21) after it emerges from the hollow conductor (19) at the upper end of the grooves (18).

FIG. 4 shows a transverse section through a hollow conductor (22) of corrugated design. This design ensures that clear annular spaces are positively provided between a hose element and the hollow conductor (22) as well as between this hollow conductor and a jacket, in which the gas can flow in either a liquid or gaseous form.

FIG. 5 shows a hollow conductor (23) formed of cable strands, filaments or cores, which overall forms a permeable structure. This hollow conductor (23) therefore requires no separate through holes to allow the gas to pass out of the hollow conductor (23). In the construction of the hollow conductor (23) as described, a hose element (24) can be used, which lies directly on the inner surface of the hollow conductor (23).

The perforations of the hollow conductor (1) can have different cross sections and different spacings with respect to each other.

I claim:

1. An induction heating coil for induction furnaces for heating, keeping hot or melting metallic material, the induction heating coil comprising a hollow electrical conductor coolable to extremely low temperatures, at least one hose element (5; 24) arranged in the hollow conductor (1; 19; 22; 23), connected to a gas connection and provided with perforations (6) through which the gas can flow between the interior and the exterior of the hose element the external diameter of the hose element (5; 24) being smaller than the internal diameter of the hollow conductor (1; 19; 22; 23), the hollow conductor having passages (6*a*) in the wall through which the gas can flow between the interior and the exterior thereof, and a jacket (8) which encloses the hollow conductor and gas emerging from the hollow conductor (1; 19; 22; 23).

2. An induction heating coil in accordance with claim 1, wherein there is only one hose element (5; 24) which passes completely through said hollow conductor (1; 19; 22; 23) and is connected to a gas connection at one end with the other end being sealed.

3. An induction heating coil in accordance with claim 1, wherein there are two hose elements (5; 24), one which extends inwardly from each end of said hollow conductor (1; 19; 22; 23), their total length being matched to the length of said hollow conductor (1; 19; 22; 23) with each one being connected to a gas connection.

4. An induction heating coil in accordance with claim 1, wherein there is only one hose element (5; 24) which passes completely through said hollow conductor (1; 19; 22; 23), and is connected at both ends to a gas connection.

5. An induction heating coil in accordance with claim 1, 2, 3 or 4, wherein the areas of the cross sections of the perforations (6) of said hose element(s) (5; 24) increase with the distance from the gas connection.

6. An induction heating coil in accordance with claim 5, wherein the spacing between successive ones of the perforations (6) of the said hose element(s) (5: 24) decreases as the distance from the gas connection increases.

7. An induction heating coil in accordance with claim 6, characterised in that the cross section is a corrugated profile.

8. An induction heating coil in accordance with claim 5, characterised in that the cross section is a corrugated profile.

9. An induction heating coil in accordance with claim 1, 2, 3 or 4, wherein the spacing between successive ones of the perforations (6) of said hose element(s) (5: 24) decreases as the distance from the gas connection increases.

10. An induction heating coil in accordance with claim 9, characterised in that the cross section is a corrugated profile.

11. An induction heating coil in accordance with claim 1, 2, 3 or 4, characterised in that the cross section is a corrugated profile.

12. An induction heating coil in accordance with claim 1, 2, 3 or 4 which further comprises an enclosure (12) which encloses the hollow conductor (1; 19; 22; 23) and which collects and carries away the gas emerging from the hollow conductor (1; 19: 22: 23).

13. An induction heating coil in accordance with claim 1, 2, 3 or 4, which further comprises a recooling device for cooling the gas emerging from the jacket (8) or the enclosure (12).

14. An induction heating coil in accordance claim 1 2, 3 or 4, which is mounted in grooves of yokes arranged around a smelting crucible.

* * * * *